US005683230A

United States Patent [19]

Karppinen

[11] Patent Number: 5,683,230

[45] Date of Patent: Nov. 4, 1997

[54] PRESSURE MEDIUM DRIVEN DEVICE PERFORMING LINEAR MOTION

[76] Inventor: Reijo Karppinen, Ratastie 12, FIN-33450 Siivikkala, Finland

[21] Appl. No.: 787,880

[22] Filed: Jan. 23, 1997

Related U.S. Application Data

[63] Continuation of Ser. No. 525,741, filed as PCT/FI94/00108, Mar. 24, 1994, abandoned.

[30] Foreign Application Priority Data

Mar. 25, 1993 [FI] Finland ..... 931324

[51] Int. Cl.[6] ..... F04B 9/08

[52] U.S. Cl. ..... 417/397; 91/224; 91/225; 91/226

[58] Field of Search ..... 91/224, 225, 226; 417/397

[56] References Cited

U.S. PATENT DOCUMENTS

| | | | |
|---|---|---|---|
| 181,386 | 8/1876 | Winchester | 91/224 |
| 208,449 | 9/1878 | Winchester | 91/224 |
| 397,958 | 2/1889 | Barth | 91/225 |
| 3,152,016 | 10/1964 | Drushella | 417/397 X |
| 3,582,238 | 6/1971 | Devine | 417/397 |
| 3,788,781 | 1/1974 | McClocklin . | |
| 3,939,755 | 2/1976 | Tabonr | 91/224 |
| 4,031,812 | 6/1977 | Koshelev | 91/224 |
| 4,352,644 | 10/1982 | Landrum et al. . | |
| 4,846,634 | 7/1989 | Vos et al. | 417/397 |
| 4,981,418 | 1/1991 | Kingsford et al. | 417/397 X |

*Primary Examiner*—Richard E. Gluck
*Attorney, Agent, or Firm*—Larson & Taylor

[57] ABSTRACT

A pressure medium operated device generating to-and-fro motion to one or several pistons or a similar motion transmitting arm. The device includes a primary piston to which motion is brought in transmitting pressure medium alternately to both sides of the piston and control valves located inside the primary piston for controlling the pressure medium which moves the primary piston.

8 Claims, 2 Drawing Sheets

1
2
3
4
5
6
7
8
9
10
11
12
13
14
15
16
17
18
19
20
21
22
23
24
24'
25
25'
26
A
B

PRESSURE MEDIUM DRIVEN DEVICE PERFORMING LINEAR MOTION

This application is a continuation of application Ser. No. 08/525,741 filed as PCT/FI94/00108 Mar. 24, 1994, now abandoned.

BACKGROUND OF THE INVENTION

1. Field of the Invention

The invention relates to a device operated by pressure medium and producing linear to-and-fro motion. The device is characterized by the construction of a primary piston with necessary valves generating the to-and-fro motion.

2. The Prior Art

Previously known motion generating devices, are a.o. hydraulic cylinders working by pressure medium and different types of percussion machines, in which the percussion piston gets its motive energy in different ways from pressure medium. In percussion machines self-acting valves are used for control of medium, whereat the percussion machines perform, automatically, continuous to-and-fro motion. E.g. U.S. Pat. No. 4,031,812. Generally, hydraulic cylinders are controlled by means of outside valves. In percussion machines a hydraylic accumulator, e.g. a blast tank, is used to charge sufficient pressure and discharge it instantly against a piston that is to be moved, in order to produce at least a one-way rapid piston motion. Generally, the valve actuators are in the body of the device and the piston is a component to transfer motion or power only.

Present devices are not applicable as permanently working generators of to-and-fro motion only by hydraulic pressure, especially when the motion should be rapid in both directions, generation of pressure shocks in the valves avoided and one would not want to use a gas containing hydraulic accumulator in order to accelerate the motions.

SUMMARY OF THE INVENTION

With a device according to this invention, working by pressure medium, particularly fluid medium, a decisive improvment of this disadvantage is achieved and the invention is characterized in what is presented in the enclosed patent claims.

A most important advantage of the invention is that by means of a built-in valve reversal free of pressure shock in the piston extreme ends is reached by prepressure control. This is of significance, since in the device a relatively voluminous stream flow is utilized in relation to its size. There will be no pressure shock in the stream line, because the piston is "freely" floating in the extreme end, i.e. it reverses along with the change of pressures active in different parts of the piston. This means that there is not an accurately determined reversal point, on reaching of which the valve would at once be mechanically closed or opened.

A further advantage of the device is its simple and solid construction and its applicability to numerous purposes. The rapid to-and-fro motion produced by the device can be utilized for pumping fluids and gases, even against great counterpressure, the device motion can be transfered into vibration of a vibrator, stroke of a percussion machine a.s.o. On changing the ratios of piston annular sections, the piston motions can be accelerated in one direction, the motion in one direction becomes stronger as well.

BRIEF DESCRIPTION OF THE DRAWINGS

In the following the invention is presented in detail with reference to the enclosed drawing, where.

DETAILED DESCRIPTION OF THE PREFERRED EMBODIMENTS

Figures 1, 3:
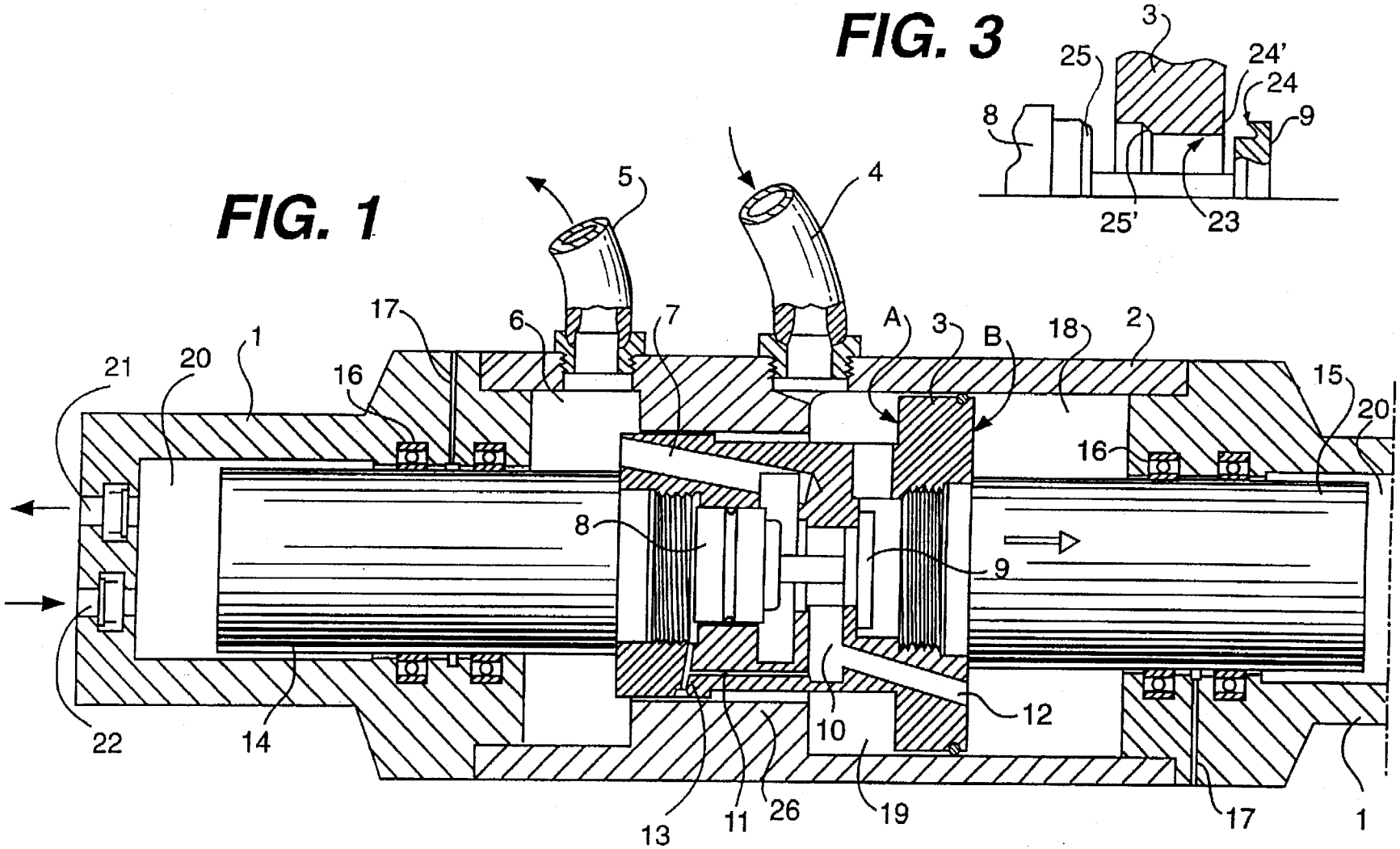
FIG. 1 is a section of a pump application.
FIG. 3 is a section of a valve.

FIG. 1 shows an exemplary pump application of the invention. The device is a hydraulically operated pump in a pressure washer with two cylinder spaces 20. The water suction ducts are 22 and pressure channels 21. Cylinders 1 are located in both ends of the device. Pumping is achieved by secondary pistons 14 and 15. Secondary pistons 14 and 15 are separated from the drive fluid space 6 and 18 by packing pairs 16. Drainages 17 are located between the packing pairs 16. Cylinders 1 and the body center 2 are pieces of simple cylinders. The pressure medium inlet channel is labeled 4 and return channel is labeled 5. Inside the body center 2 there is a primary piston 3, and the diameter of the actual piston part is the greatest ring shaped part. Secondary pistons 14 and 15 are fastened to primary piston 3 by a threaded screw-type connection.

FIG. 1 shows all pistons in motion in the arrow direction to the right. The fluid pressure is acting on the primary piston 3 ring surface A forcing the piston to the right. The pressure in chamber space 18 exits over channels 12, 10 and 7 to return pipe 5. Valve member 8,9 stays on the left, while the pressure is acting on the shut-off part 9. Piston 3 travels to its extreme position on the right. The extreme position, where the piston motion reverses, is determined by the travel of discharge channel 13 to the edge of ring chamber 19. Thereby, over discharge channel 13 full driving pressure is produced behind piston part 8 of valve member 8,9 pressing the valve to the right and opening the channel closed by shut-off part 9. The gap section of piston part 8 is greater in area than the area of gap 23 that is closed by shut-off part 9.

On rapid travel of valve member 8,9 to the right, the pressure ratios on sides A and B of primary piston 3 change immediately. The shut-off part 9 opens gap 23 it has locked and piston part 8 travels to close the gap leading to the channel. Now, primary piston 3, with the pump pistons 14,15 fixed to it, reverses and starts back to the left. On sides A and B of primary piston 3 the same full pressure is active and, owing to the greater area of side B, piston 3 starts to the left by the force acting on side B. During this motion, the fluid in chamber 6 streams out to the return line. In a combination as per FIG. 2, piston 3 moves to the left and FIG. 2 shows a situation where the motion of pistons is just in the extreme position on the left.

Figure 2:
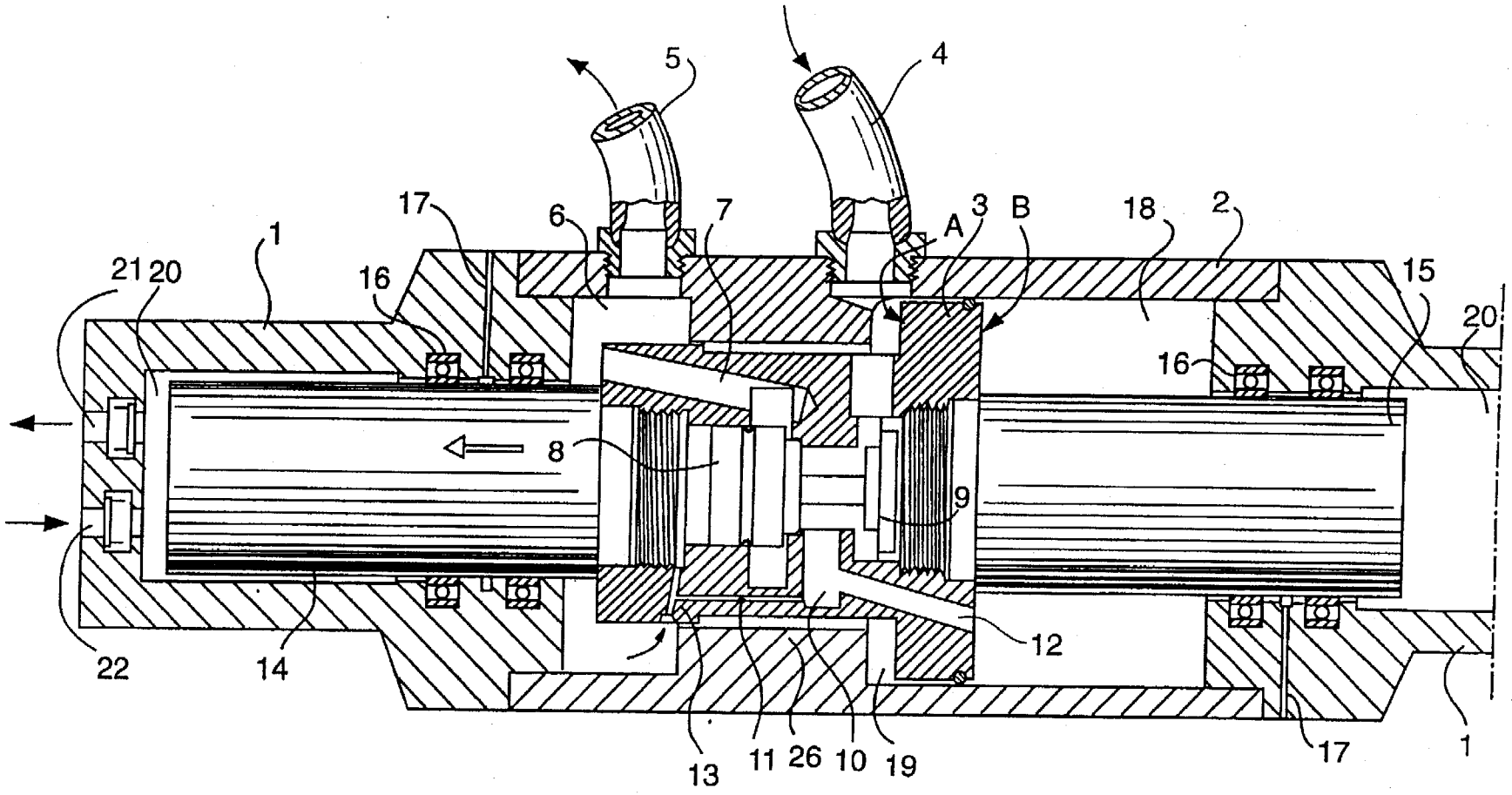
FIG. 2 is a section of the pump application in FIG. 1 with reversing piston.

FIG. 2 shows valve member 8,9 still in the space where pistons 3,14,15 are moving to the left. Shut-off part 9 is freely moveable in the chamber. Piston part 8 is pushed by full pressure to the left by a force determined by the gap section of the shut-off gap and to the right by full pressure from the rear space of piston part 8. Piston part 8 keeps its position on the right until, in a situation as per FIG. 2, the discharge channel 13 reaches again the edge of ring chamber 6, at which time the pressure behind piston 8 sinks remarkably. Full pressure through the shut-off gap to piston part 8 can now move the piston part to the left shut-off position and, in its turn, the shut-off part 9 closes gap 23 and thus the situation as per FIG. 1 is reached. The length of travel of the primary piston is determined by the length of land 26.

Discharge channel 13 is connected to channel 10 by a branch channel, which has a choking section 11. With the side branch the valve function is made more reliable and thus more distinctive pressure differencies can be produced in order to move valve member 8,9.

FIG. 3 shows a part enlargement and section of the valve member 8, 9 construction. The ring-shaped bevel surface 25 of piston part 8 is tight against the corresponding facing surface 25' of part 3. Then the pressure acting over shut-off gap 23 upon piston part 8 is active on the front surface of piston part 8 only on an area as big as shut-off gap 23. Immediately, upon the slightest opening of this valve, the pressure acts rapidly also on bevel surface 25 and the force of motion on valve member 8, 9 increases at once. The cylindrical surface of shut-off part 9 is not tight against the inner surface of opening 23 and sealing is performed with top surface 24 of shut-off part 9 against front facing surface 24' of part 23. With this construction, reliable functioning of the device is achieved. Also, this shut-off part acts in the same way as the valve applied to piston 8, i.e., when the shut-off part 9 closes gap 23 by means of its ring-shaped top surface 24 and starts to open, the pressure can act immediately by the top surface 24 on the greater ring-shaped area located towards the center. The force thus generated makes the motion of shut-off part 9 to the right more effective and rapid. The above-described property is most advantageously achieved in using seat valves as shown in FIG. 3.

The to-and-fro motion of primary piston 3 can be utilized in different kinds of devices. Pistons 14,15, or only either of them, can be replaced by a moving arm coming out from the housing and the motion of it utilized. Anyway, the aim is not to restrict the device to certain applications but many modifications are possible within the inventional concept determined in the enclosed patent claims.

I claim:

1. A pressure medium operated device comprising:

a body forming an enclosed space, said body having an inlet port, an outlet port, and a land having two ends;

a pressure medium that enters said enclosed space via said inlet port and exits said enclosed space via said outlet port, wherein an operating pressure is supplied to said device by said pressure medium entering said input port;

a primary piston alternately driven in a backward and a forward direction within said enclosed space by the operating pressure of said pressure medium, said primary piston comprising a first driving surface, a second driving surface located opposite said first driving surface and having a surface area greater that of said first driving surface, a built-in control valve system disposed within said primary piston, and a discharge channel having a first opening into said built-in control valve system and a second opening that is temporarily sealed when said discharge channel is positioned between said two ends of said land, wherein said built-in control valve system and said discharge channel together control the operation of the pressure of said pressure medium to the primary piston and thus the direction of movement of the primary piston, said built-in control valve system comprising:

a first facing surface and a second oppositely facing surface disposed on said primary piston, and a valve member disposed within said primary piston, said valve member including a first ring-shaped surface and a second ring-shaped surface, each of said first and second ring-shaped surfaces respectively cooperating with said first and said second oppositely facing surfaces in an alternating fashion such that when said first ring-shaped surface abuts against said first facing surface, said pressure medium is directed to supply the operating pressure against said first driving surface to move said primary piston and said discharge channel in the forward direction until said discharge channel reaches one end of said land of said body to open said discharge channel to allow said pressure medium to shift said built-in control valve system such that said second ring-shaped surface abuts against said second facing surface which equates the pressure on each of said driving surfaces and thereby drives said primary piston in said backward direction due to the equal pressure upon the greater surface area of said second driving surface until said discharge channel reaches the other end of said land which enables said discharge channel to vent said pressure by allowing said pressure medium to exit said outlet port and thereby allow said pressure to shift said built-in control valve system so that said first ring-shaped surface and said first facing surface are once again engaged by the operating pressure of said pressure medium entering said input port which once again drives said piston in said forward direction.

2. A device according to claim 1 further comprising a pair of pumping pistons attached to said primary piston and positioned end-to-end, said primary piston being moved by said operating pressure of said pressure medium to in turn move said pair of pumping pistons, and wherein said valve member is controlled by said operating pressure.

3. A device according to claim 1 further comprising a suction duct to draw in pumped fluid and a pressure channel to expel pumped fluid, and wherein movement of said primary piston in one direction creates a suction force in said suction duct, and movement of said primary piston in an opposite direction creates a pressure force in said pressure channel.

4. A device according to claim 1 wherein said first ring-shaped surface is formed by a circular depression on said valve member.

5. A device according to claim 1 wherein said second ring-shaped surface is formed by a bevel surface on said valve member.

6. A device according to claim 1 wherein said built-in control valve system further comprises an internal channel that is open to said outlet port when said first facing surface and said first ring-shaped surface abut, and is closed to said outlet port when said second facing surface and said second ring-shaped surface abut.

7. A device according to claim 4 further comprising a branch channel having a choking section, wherein said branch channel connects said discharge channel and said internal channel, and during motion in said forward direction when said discharge channel is temporarily sealed, said choking section inhibits the operating pressure from making said second facing surface abut said second ring-shaped surface, and when said discharge channel is unsealed and beyond said one end of said land, said discharge channel allows said operating pressure to shift said built-in control valve system so said second facing surface abuts said second ring-shaped surface.

8. A device according to claim 4 wherein when said discharge channel is temporarily unsealed by being positioned beyond said other end of said land, said discharge channel vents the operating pressure that maintains the abutment between said second facing surface and said second ring-shaped surface, said venting allowing said operating pressure to shift said built-in control valve system such that said first facing surface abuts said first ringed-shaped surface, which in turn drives said primary piston in said forward direction.

* * * * *